US008479328B2

(12) United States Patent
Srour et al.

(10) Patent No.: US 8,479,328 B2
(45) Date of Patent: Jul. 9, 2013

(54) ADJUSTABLE BRACKET FOR A CRIB MATTRESS

(76) Inventors: Mark Srour, Brooklyn, NY (US); Joey Srour, Brooklyn, NY (US)

( * ) Notice: Subject to any disclaimer, the term of this patent is extended or adjusted under 35 U.S.C. 154(b) by 289 days.

(21) Appl. No.: 13/062,446

(22) PCT Filed: Sep. 26, 2008

(86) PCT No.: PCT/US2008/011225

§ 371 (c)(1),
(2), (4) Date: Mar. 4, 2011

(87) PCT Pub. No.: WO2009/042221

PCT Pub. Date: Apr. 2, 2009

(65) Prior Publication Data

US 2012/0102641 A1 May 3, 2012

Related U.S. Application Data

(60) Provisional application No. 60/960,371, filed on Sep. 26, 2007.

(51) Int. Cl.

| | |
|---|---|
| ***A47D 7/00*** | (2006.01) |
| ***A47C 31/00*** | (2006.01) |
| ***E06B 7/28*** | (2006.01) |

(52) U.S. Cl.
USPC ..... 5/93.1; 5/11; 248/244

(58) Field of Classification Search
USPC ..... 5/93.1, 100, 425, 428, 430, 204, 5/177, 232; 248/219.4, 279.1, 244
See application file for complete search history.

(56) References Cited

U.S. PATENT DOCUMENTS

| | | | | | |
|---|---|---|---|---|---|
| 668,038 | A | * | 2/1901 | Duhamel | 108/4 |
| 3,129,439 | A | | 4/1964 | Michal | |
| 3,192,596 | A | * | 7/1965 | Gruber | 27/12 |
| 3,590,403 | A | | 7/1971 | Mixon | |
| 3,680,155 | A | | 8/1972 | McMann | |
| 3,760,434 | A | * | 9/1973 | Neunherz et al. | 5/11 |
| 3,911,510 | A | | 10/1975 | Bryant | |
| 4,226,452 | A | * | 10/1980 | Hoffman et al. | 292/175 |
| 4,639,956 | A | * | 2/1987 | Shamie | 5/93.1 |
| 4,752,978 | A | | 6/1988 | Simpson | |
| 4,982,463 | A | * | 1/1991 | Burnham | 5/11 |

(Continued)

FOREIGN PATENT DOCUMENTS

| | | |
|---|---|---|
| WO | WO 98/31259 | 7/1998 |
| WO | WO 2009/024972 | 2/2009 |

*Primary Examiner* — Robert G Santos
*Assistant Examiner* — Myles Throop
(74) *Attorney, Agent, or Firm* — Richard C. Litman

(57) ABSTRACT

The adjustable bracket for a crib mattress platform includes a first embodiment having a slotted plate (26) attached to each rear corner post (20), (22) of the crib (10). Each plate (26) includes a series of lands (30) extending from the slot (28). A mattress platform corner bracket (42) attaches to each rear corner of the mattress platform (24), with a pin (50) extending from each corner bracket (42) and engaging the slot (28) of the corresponding corner post plate (26). The pin (50) selectively engages one land (30) of the corner post plate slot (28) to set the mattress platform height. A second embodiment includes two sliding sleeves (102) installed upon spaced apart vertical slats (104) of the crib rear wall (14). A mattress platform attachment bracket extends pivotally from each sleeve. The crib wall slats (104) have a series of receptacles (132), with locking pins (114) extending from the assemblies and engaging the receptacles (132, 134) to fix the height of the mattress platform as desired.

10 Claims, 10 Drawing Sheets

U.S. PATENT DOCUMENTS 5,201,085 A * 4/1993 Shamie ..... 5/93.1
5,361,432 A * 11/1994 Shamie ..... 5/11
5,483,902 A * 1/1996 Grosch ..... 108/143
6,052,853 A 4/2000 Schmid
6,167,580 B1 * 1/2001 Draheim et al. ..... 5/100
6,175,974 B1 * 1/2001 Draheim ..... 5/100
6,658,680 B2 * 12/2003 Osborne et al. ..... 5/600
6,669,244 B1 * 12/2003 Bredthauer ..... 292/150
6,817,046 B1 * 11/2004 Srour et al. ..... 5/99.1
6,886,196 B2 * 5/2005 Nygren et al. ..... 5/430
7,039,971 B2 * 5/2006 Sebastien ..... 5/662
D523,257 S 6/2006 Kassai et al.
7,568,244 B1 * 8/2009 Shamie et al. ..... 5/100
8,112,834 B1 * 2/2012 Shamie et al. ..... 5/93.1
2004/0187212 A1 * 9/2004 Pacella ..... 5/503.1

* cited by examiner

ADJUSTABLE BRACKET FOR A CRIB MATTRESS

CROSS-REFERENCE TO RELATED APPLICATION

This application is a 371 of PCT/US2008/011225, filed Sep. 26, 2008, which claims the benefit of U.S. Provisional Patent Application Ser. No. 60/960,371, filed Sep. 26, 2007.

TECHNICAL FIELD

The present invention relates generally to cribs and beds, and more particularly to an adjustable bracket for a crib mattress platform that permits the height of the mattress platform to be adjusted as desired, permitting the crib to be used for different functions.

BACKGROUND ART

Baby cribs are conventionally used for sleeping infants and very small children, with such cribs typically being relatively specialized articles of furniture with relatively high sides to prevent the child from rolling or climbing from the crib. Many, if not most, cribs include a "drop side" in which one side of the crib may be lowered to facilitate access to the crib interior by the parent or guardian, and many such cribs include structure which permits the crib to be folded when not in use or for portability.

Nonetheless, such cribs remain as relatively specialized devices, with infants and small children further requiring additional furnishings for other purposes, e.g., changing tables, playpens, etc. These additional furnishings not only add further to the cost of raising and caring for an infant, but they require additional space in the home or apartment, with such space perhaps already being at a premium in a small home with other siblings of the infant. Yet, the general structure of a conventional crib contains many of the features required to serve in other capacities, i.e., a level surface which may be padded and easily cleaned for use as a changing table or surface, and relatively high sides which could allow the device to be used as a playpen if properly configured. However, conventional cribs fix the height of the mattress platform or supporting surface at a single height. This height is optimized for use as a crib, but is too low for convenient use by a parent or guardian as a changing table and too high for safe use of the crib as a playpen or the like.

Thus an adjustable bracket for a crib mattress platform solving the aforementioned problems is desired.

DISCLOSURE OF INVENTION

The adjustable bracket for a crib mattress platform attaches the mattress platform to the crib structure, and permits the mattress platform to be adjusted to any one of a series of different levels in the crib structure and positively locked at the desired level. This permits the crib to be used for a variety of different functions, e.g., as a crib, playpen, or changing table or surface, depending upon the height to which the mattress platform is adjusted.

A first embodiment of the bracket includes an elongated steel (or other hard material) plate attached to the inner surface of the rear post of the crib. The plate includes a slot formed therein, with the sides or edges of the slot having a series of lands extending therefrom. A corresponding corner bracket is attached to a corner of the mattress platform, with the corner bracket having a pin extending therefrom which passes into the slot of the corner post plate. The corner post is routed out behind the plate, with the corner bracket pin having a larger diameter head, which is captured, behind the slot of the corner post plate to preclude escape therefrom. A larger diameter passage may be provided at one point along the corner post plate to permit intentional removal of the mattress platform from the crib structure, when desired. A pair of such assemblies in mirror image to one another is installed at the opposite rear corner posts of the crib. Alternatively, additional corner post plates may be installed upon the front corner posts of the crib if so desired, with corresponding corner brackets being installed on the corresponding corners of the mattress support platform. These third and fourth corner post plates and corner brackets allow the mattress support platform to be adjusted in a substantially level attitude to any of the corresponding lands or stops of the four corner post brackets as desired.

A second embodiment of the bracket comprises a sleeve that slides along one of the vertical slats of the rear wall of the crib, with a mattress platform attachment bracket being pivotally attached to the slat attachment sleeve by a lug, which extends from the sleeve. The crib slat further includes a series of receptacles therealong, with the receptacles receiving the end of a height locking pin, which extends from the platform attachment bracket. The height locking pin selectively engages one of the receptacles formed in the crib slat, to lock the bracket (and thus the mattress platform) at the selected height or level. The height locking pin is positively engaged in the selected slat receptacle by a tab, which extends from the mattress platform attachment bracket, with the tab bearing against the pin to force the pin into engagement with the slat receptacle. Two or more such assemblies are attached to widely spaced crib slats and corresponding locations along the attachment edge of the mattress platform. The two embodiments may be installed together on a single crib to allow the user to select the configuration desired, or a single embodiment may be installed on a crib.

These and other features of the present invention will become readily apparent upon further review of the following specification and drawings.

BRIEF DESCRIPTION OF THE DRAWINGS

Similar reference characters denote corresponding features consistently throughout the attached drawings.

BEST MODES FOR CARRYING OUT THE INVENTION

Figure 1:
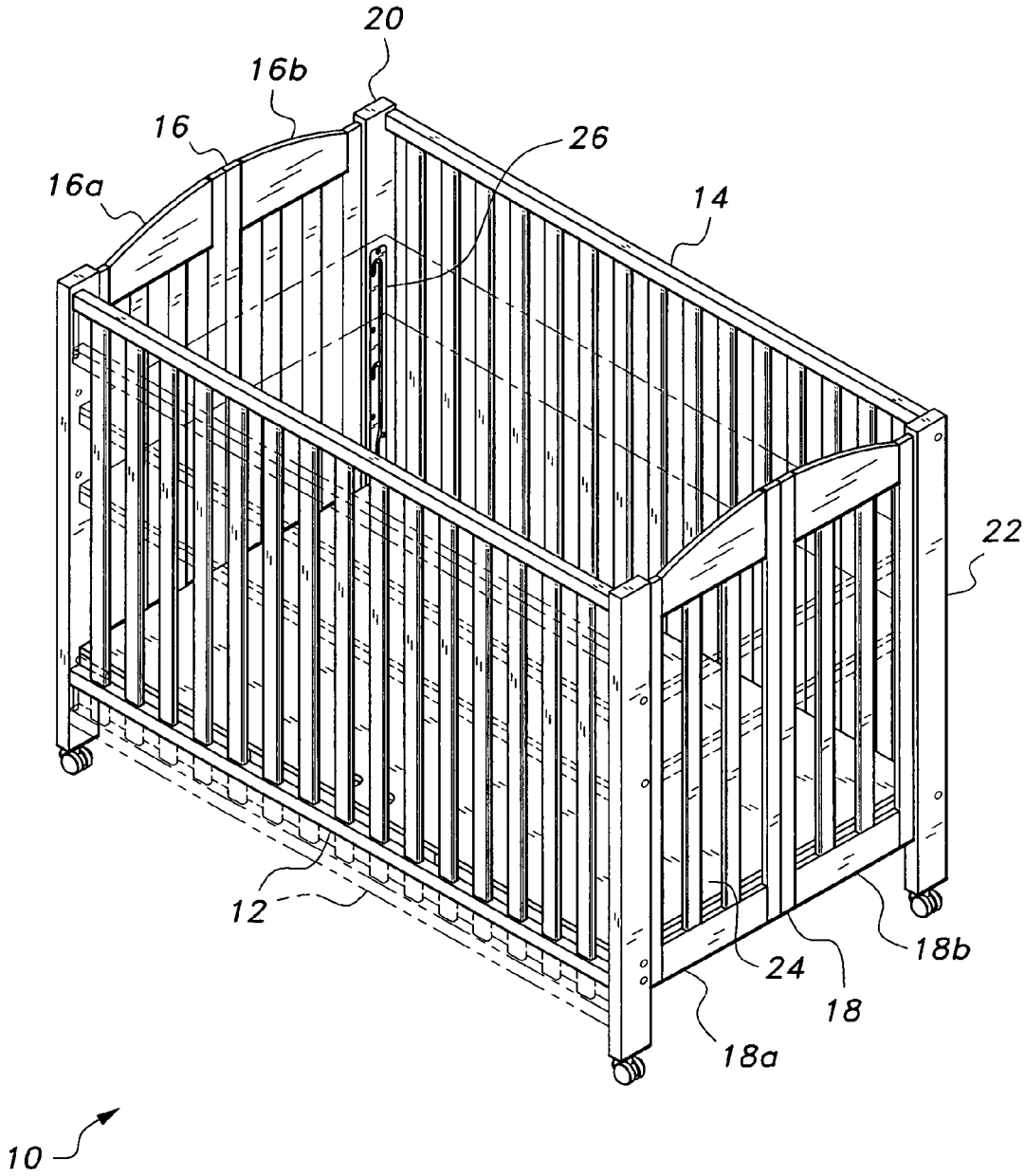
FIG. 1 is a perspective view of a baby crib incorporating a first embodiment of an adjustable bracket for a crib mattress platform according to the present invention.

The present invention comprises various embodiments of an adjustable bracket or bracket assembly for adjusting and locking the height of the mattress platform in a baby crib or the like. This device in its various embodiments allows the crib to be used for additional purposes beyond serving as a bed for a sleeping infant or child, by allowing a parent or guardian to adjust the height of the mattress platform as required for other functions.

FIGS. 1 through 5 of the drawings illustrate a first embodiment of the adjustable bracket assembly, including a crib 10 and portions thereof to which the bracket assembly is installed. The crib 10 includes a vertically adjustable front wall 12, an opposite rear wall 14, a first end panel 16, and an opposite second end panel 18. The rear wall 14 is joined to the two end panels 16 and 18 by respective first and second corner posts 20 and 22. A flat, substantially rigid mattress platform 24 extends essentially completely across the area contained by the walls and end panels 12 through 18, and is adjustably and removably installed therein.

Figure 2:
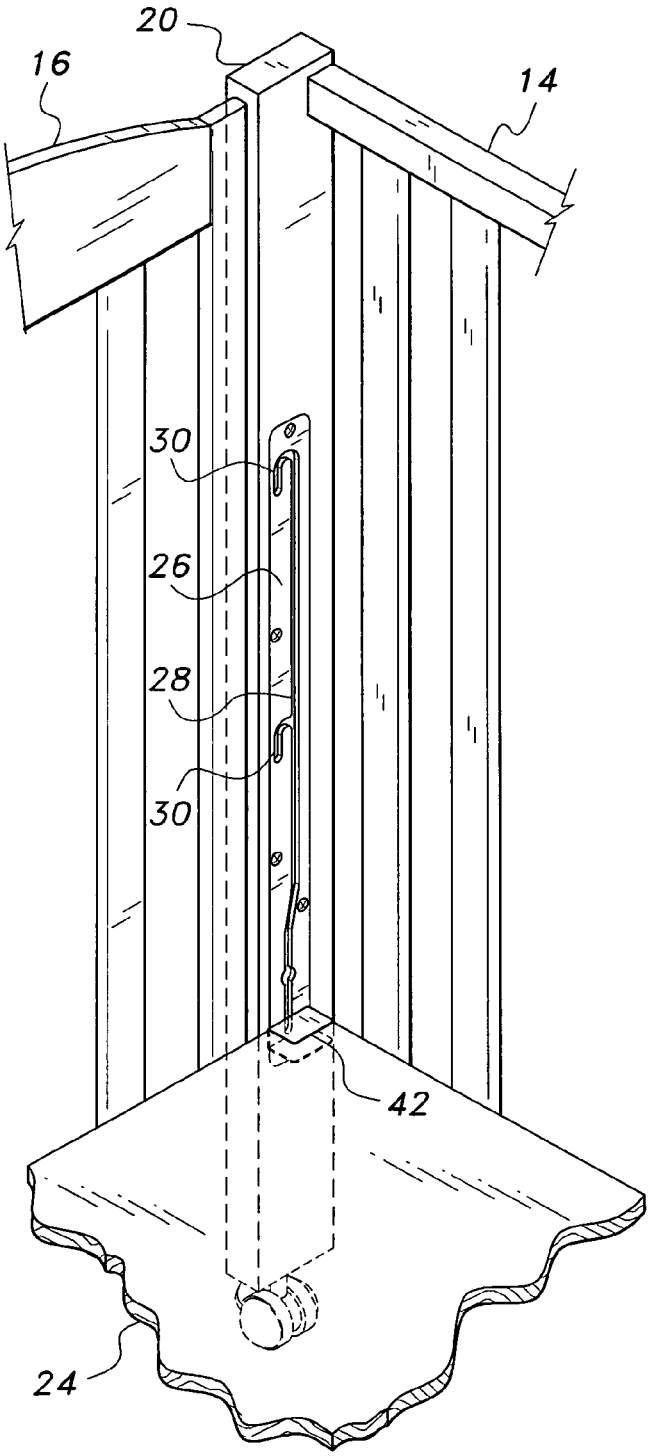
FIG. 2 is a broken away detailed perspective view of the first rear corner post of the crib of FIG. 1, showing further details of the first embodiment adjustable bracket.
Figure 3:
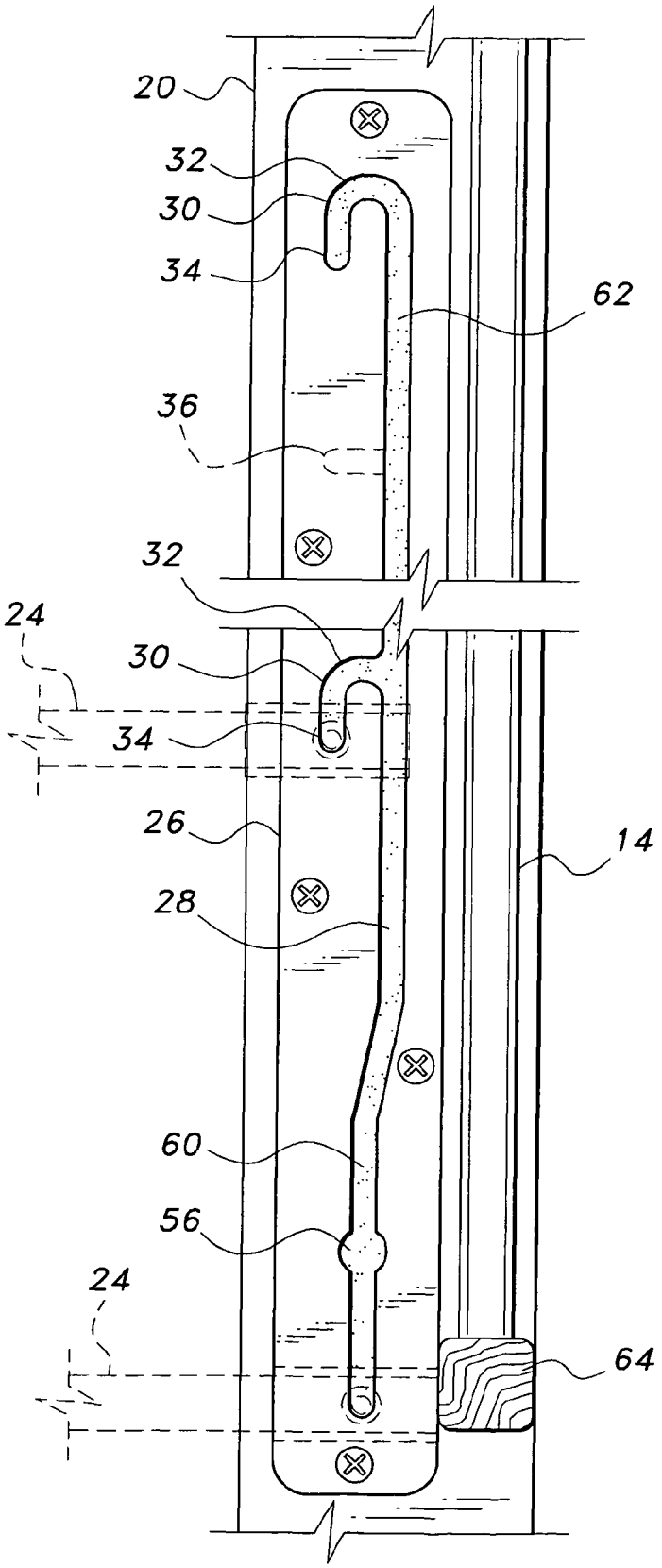
FIG. 3 is a detailed front elevation view of the corner post bracket plate of the adjustable bracket of FIGS. 1 and 2, with two levels of adjustment of the mattress platform shown in broken lines.
Figure 4:
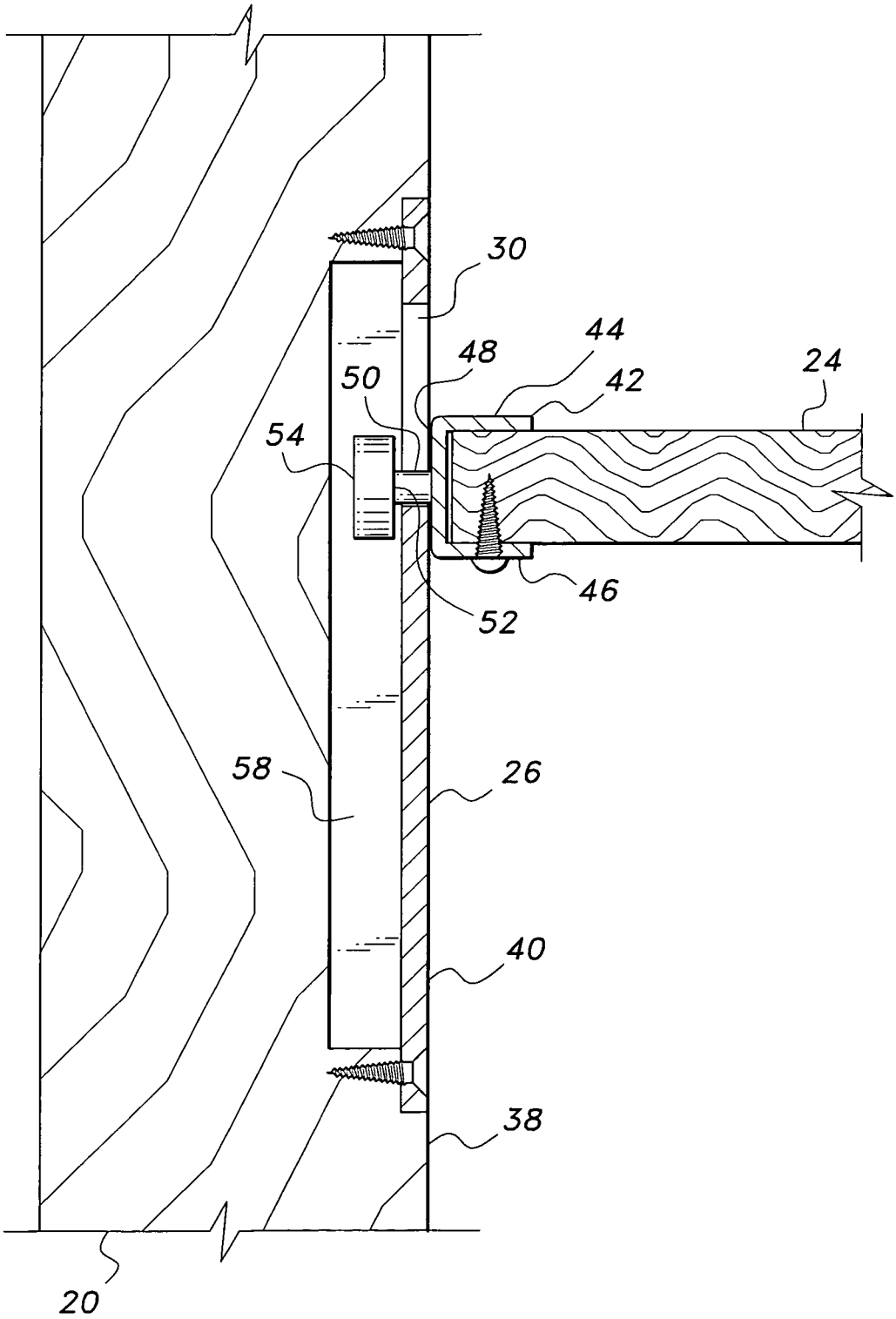
FIG. 4 is a detailed side elevation view in section of the corner post bracket plate and mattress platform corner bracket installation assembly for the crib of FIG. 1, showing further details thereof.

The adjustable bracket assembly includes a flat, elongate corner post plate 26 permanently secured to each of the two corner posts 20 and 22. The two plates 26 installed in a single crib 10 are mirror images of one another, and face one another across the span of the rear wall 14 of the crib. FIGS. 2 through 4, and particularly FIG. 3, provide more detailed views of an exemplary first corner post plate 26. Each corner post plate further includes a mattress platform height adjustment slot 28 formed therethrough, with the slot 28 having a series of lands or stops extending generally laterally therefrom. These lands or stops may comprise any practicable shape or configuration, with two examples being illustrated in FIG. 3. The lands 30 each include an arcuate upper portion 32, with a relatively short, straight lower portion 34 depending from the curved upper portion and essentially parallel to the slot 28 to form an inverted "J" shape. An alternative land 36 is illustrated in broken lines in FIG. 3, with the land 36 comprising a substantially horizontal segment extending substantially normal to the slot 28. Other configurations may be used, so long as they provide a stop for the mattress platform corner bracket described further below.

Preferably, each of the corner post plates 26 is installed flush with its corner post 20, 22, i.e., the two facing surfaces 38 of the corner post 20 and 22 are mortised or otherwise worked to provide a recess equal in depth to the thicknesses of their corner post plates 26, with the exposed surfaces 40 of the plates 26 being coplanar with their facing corner post surfaces 38, as shown in FIG. 4 of the drawings. The screw holes of the two plates are preferably countersunk to allow for the installation of flat head screws securing the plates 26 to their respective corner posts 20 and 22.

FIG. 4 also illustrates one of the two mattress platform corner brackets 42 which attach to opposite rear corners of the mattress platform 24 and engage the respective corner post plates 26. The exemplary corner bracket 42 shown in cross section in FIG. 4 includes a flat upper plate 44, a flat lower plate 46 parallel to the upper plate, and a medial plate 48 joining the upper and lower plates 44 and 46. The upper and lower plates 44 and 46 capture the rear corner of the mattress platform 24 therebetween, with one or more screws preferably being driven through the lower plate 44 to secure the corner bracket 42 to the corner of the mattress platform 24.

A plate engagement pin 50 extends from the medial plate 48, and passes through the slot 28 of the corner post plate 26. The distal end 52 of the pin 50 includes a relatively larger diameter head 54 extending therefrom, with the diameter of the head 54 being larger than the width of the slot 28 through the height adjustment plate 26 so that the head 54 is captured behind the corner post plate 26 when the pin 50 is installed in the slot 28 of the corner post plate 26. However, the height adjustment slot 28 of the corner post plate 26 includes a larger diameter passage 56 therein (shown most clearly in FIG. 3), with the passage 56 being sufficiently large to allow the head 54 of the corner bracket 42 to pass therethrough when assembly and disassembly is required. However, ordinary manipulation and adjustment of the mattress platform 24 does not allow the head 54 of either of the corner bracket pins 50 to pass through their corner post plate passages 56, thus assuring that the mattress platform 24 remains attached to the crib structure. FIG. 4 also illustrates the clearance volume 58 formed within the corner post 20, to provide clearance for the pin head 54 of the corner bracket 42. This allows the mattress platform 24 to be readily adjusted as desired, and precludes any binding or jamming of the pin head 54 within the corner post 20.

It will be noted in FIG. 3 of the drawings, that the corner bracket pin slot 28 of the corner post plate 26 is not straight. The slot 28 includes a lower portion 60, containing the corner bracket pin head installation and removal passage 56, and an opposite upper portion 62, which is axially offset from the lower portion. The offset of the lower portion 60 away from the rear wall 14 of the crib structure, provides clearance for the edge of the mattress platform 24 relative to the bottom crossmember 64 of the rear wall 14 when the platform 24 is lowered to its lowermost position as shown in broken lines in FIG. 3. However, the upper portion 62 of the slot 28 is offset closer to the rear wall 14, to provide sufficient area in the plate 26 for the various lands 30 and/or 36 for repositioning the mattress platform 24 as desired.

The above-described assembly comprises only two corner post plates 26 installed in the two rear corner posts 20 and 22 of the crib 10 to allow the mattress support platform 24 to hinge or pivot about the two rear corner bracket pins captured by the two rear corner post plates. However, it will be noted that third and fourth corner post plates may optionally be installed upon the two front corner posts of the crib, with corresponding corner brackets installed on the corresponding corners of the mattress support platform. These third and fourth corner post plates serve as stops or supports for the forward edge or corners of the mattress support platform 24 in lieu of the stops 70, shown attached to the front corner post of the crib 10 in FIG. 5. The third and fourth corner post plates are installed to have the same orientation as the rear corner post plates, i.e., with their slot lands oriented toward the front wall of the crib. This allows the four pins of the four corner brackets of the mattress support platform to translate simultaneously in their corresponding four corner post plate slots and lands. While this arrangement does not permit the mattress support platform to hinge or pivot from one side or wall of the crib, it does allow the platform to be adjusted in a substantially level attitude to any of the lands or stops of the four corner post plates.

Figure 5:
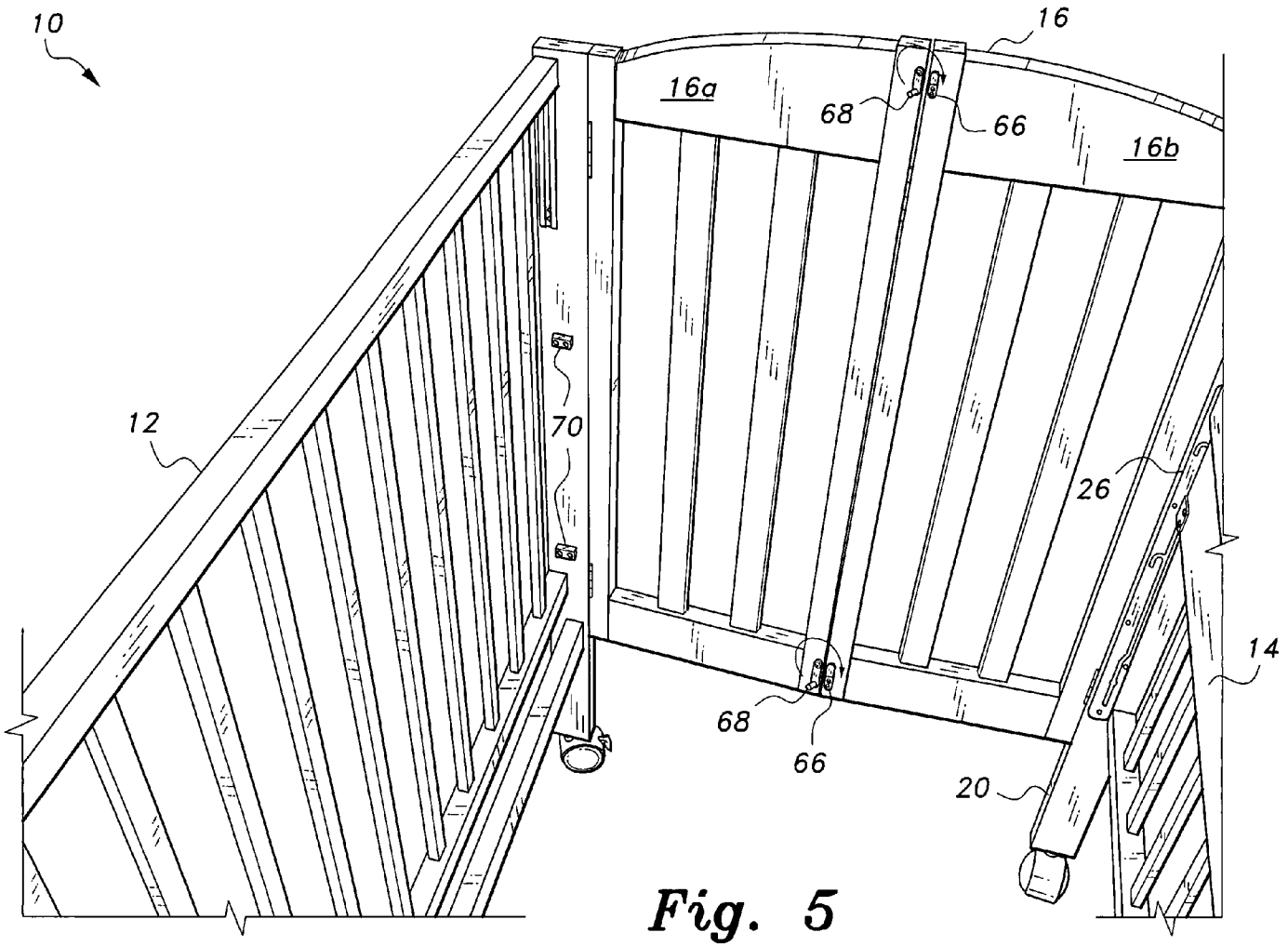
FIG. 5 is an interior perspective view of one end of the crib of FIG. 1, showing further details of the stops for the forward edge of the mattress platform and other features.

The crib 10, including the mattress platform height adjustment bracket structure described above, is capable of folding for compact storage and shipment. Each of the end panels 16 and 18 actually comprises two portions, i.e., front and rear portions 16*a* and 16*b* for the left or first end panel 16 and front and rear portions 18*a*, 18*b* for the right or second end panel 18. FIG. 5 of the drawings provides an interior view of the two panel portions 16*a*, 16*b* for the first panel 16. The two panel portions 16*a*, 16*b* and 18*a*, 18*b* are pivotally attached to one another and to their respective front and rear walls 12 and 14. Each of the panel portions folds inwardly, i.e., their hinge lines moving toward one another and drawing the front and rear walls 12 and 14 toward one another to provide for compact storage of the crib 10 when not in use.

However, each end panel assembly, e.g., the first end panel 16 comprising the end panel portions 16*a*, 16*b*, may be extended and locked in a coplanar configuration when the crib 10 is fully opened for use. This is accomplished by a catch 66 installed upon one of the panel portions, e.g., 16*b*, adjacent to its attachment to the opposite panel portion, and a corresponding finger 68 attached to the opposite panel portion. The finger 68 may be selectively rotated to drop into the opposite but adjacent catch 66 to hold the two panel portions 16*a*, 16*b* in rigid coplanar alignment with one another as desired. It will be noted that two such latch assemblies each comprising a catch 66 and finger 68 are illustrated in FIG. 5. However, a single latch assembly may be provided if desired. FIG. 5 also illustrates the stops 70 provided at the ends of the front wall 12, for supporting the forward edge of the mattress platform 24 at the desired height depending upon its adjustment at the rear corner post plates 26.

FIGS. 6 through 10 illustrate another adjustable bracket embodiment for adjusting the height of the mattress platform in a crib. The crib 10 and portions thereof shown in FIGS. 6 through 10 are identical to the crib 10 and its components illustrated in FIGS. 1 through 5, with the exception of the lack of the two corner post plates and corresponding configuring of the corner posts for installation of the corner post plates and minor modification of two of the vertical slats forming the rear wall 14 of the crib.

Figure 6:
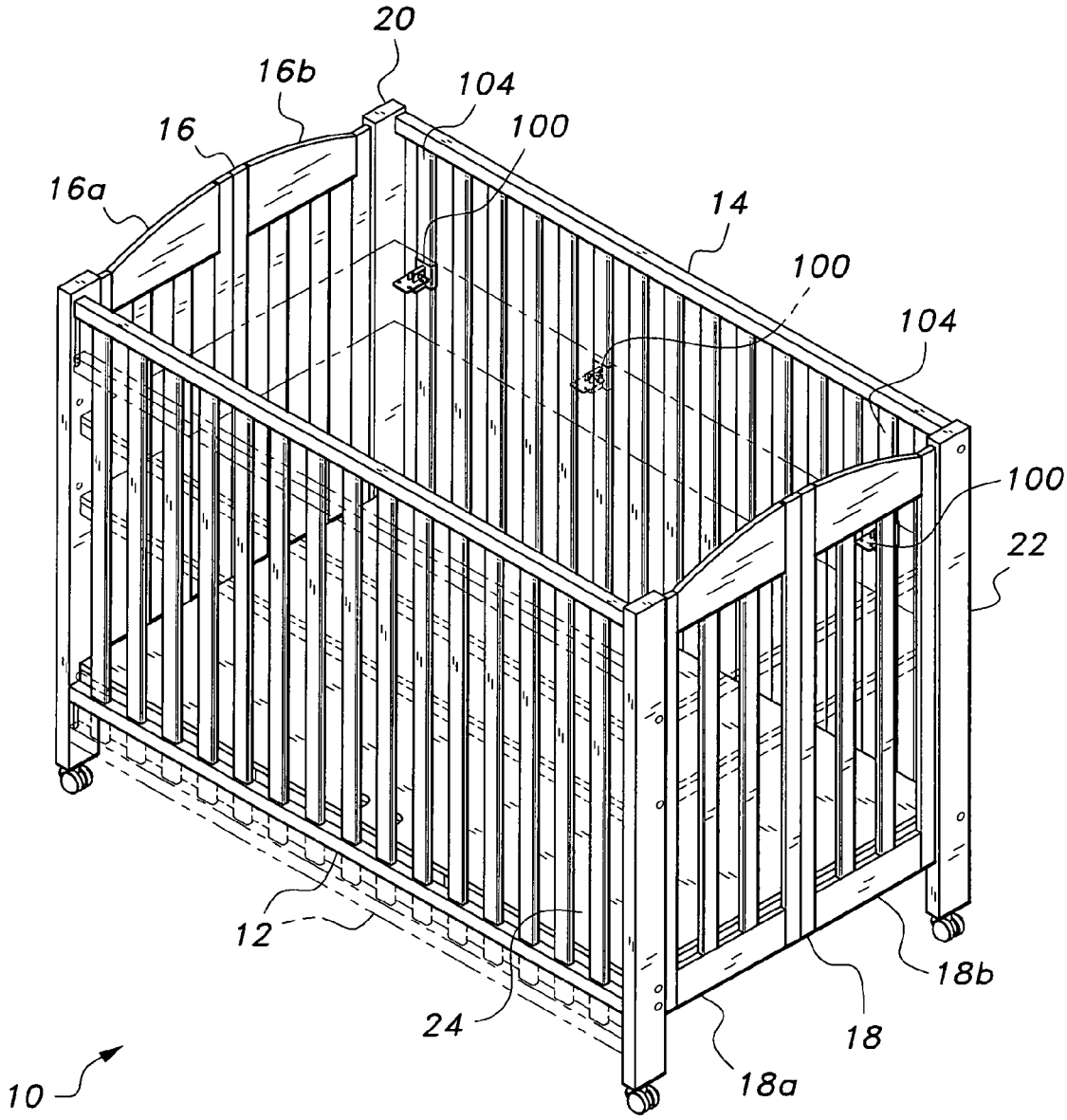
FIG. 6 is a perspective view of a baby crib incorporating a second embodiment of an adjustable bracket for a crib mattress platform according to the present invention.
Figure 7:
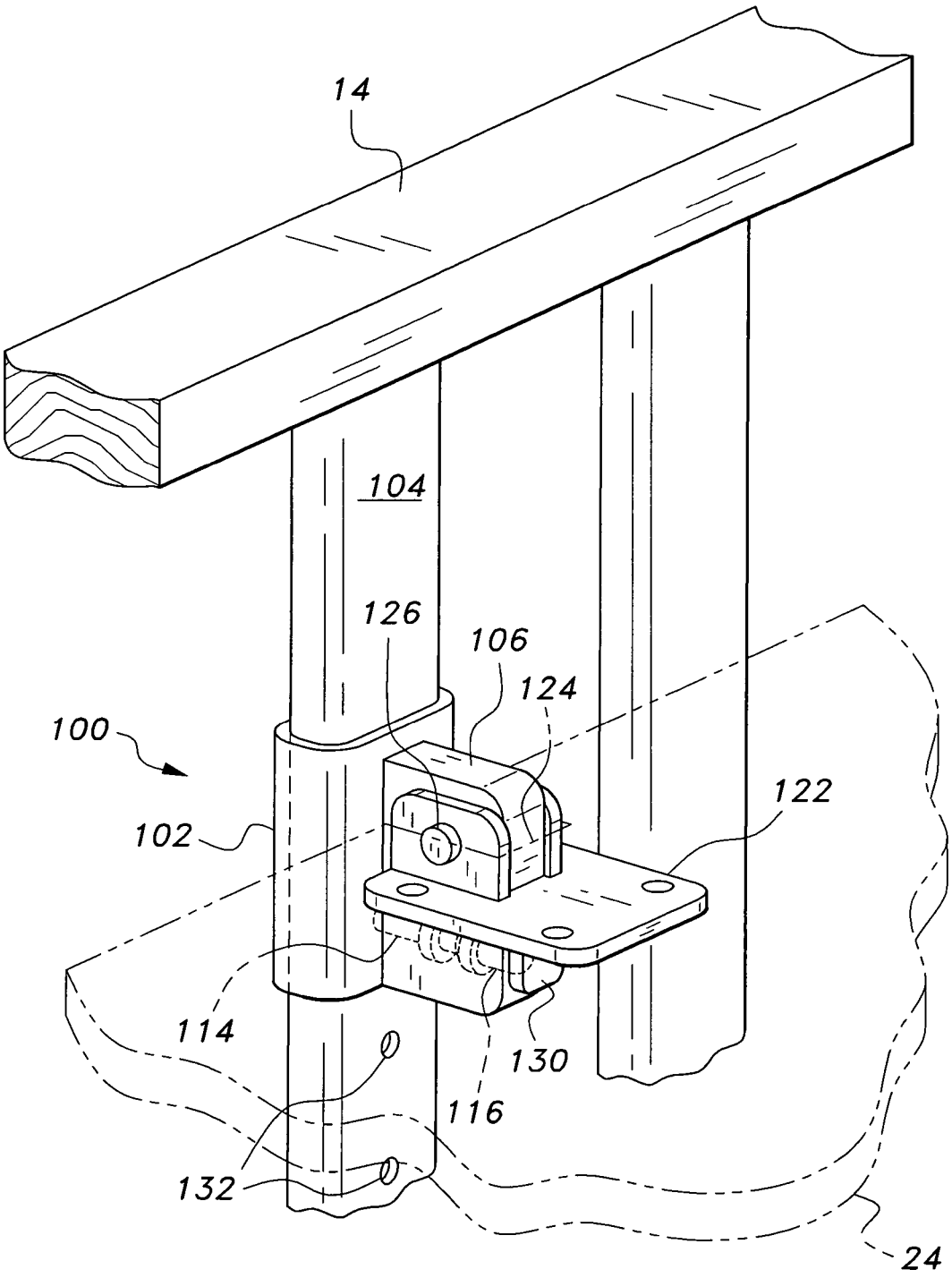
FIG. 7 is a broken away detailed perspective view of a portion of the rear wall of the crib of FIG. 6, showing further details of the second embodiment of the adjustable bracket installed thereon.

FIG. 6 shows the installation of a pair of adjustable bracket assemblies 100 on a crib 10, with FIG. 7 providing a detailed perspective view of a single such bracket assembly 100. It will be noted that a third bracket assembly 100 is shown in broken lines in FIG. 6, centrally disposed between the bracket assembly pair shown in solid lines. Such an optional third (or more) bracket assembly or assemblies may be installed along any of the crib slats to provide additional support for the bracket or hinge attachment edge of the mattress support platform.

The bracket assembly 100 includes a slat attachment sleeve 102, which slides adjustably upwardly and downwardly upon one of the vertical slats 104 of the rear wall 14 of the crib 10. The sleeve 102 has an internal configuration conforming to the external cross sectional shape of the slat 104 upon which it is installed, e.g., round, oval, etc. The sleeve 102 and remainder of the bracket assembly 100 are preferably installed upon the slat 104 at the time of manufacture of the crib 10, i.e., the sleeve 102 is first installed upon the selected slat 104 before the slat 104 is assembled with the upper and lower horizontal rails to form the completed rear wall 14 of the crib. It will be seen that the mattress platform height adjuster assembly 100 of FIGS. 6 through 10 may be installed upon a crib 10 incorporating the corner post plate 26 and corner bracket 42 adjuster assembly shown in FIGS. 1 through 5, if so desired. This permits the user of the crib 10 to select whichever mattress platform height adjuster mechanism he or she wishes to use, as desired.

The adjuster assembly 100 includes a mattress platform attachment lug 106 extending inwardly from the sleeve 102, i.e., toward the interior of the crib 10. The lug 106 includes a slat locking pin passage 108 formed therethrough and normal to the sleeve 102, i.e., extending radially from the sleeve. The slat locking pin passage 108 includes a sleeve end 110 which communicates with the interior of the sleeve 102 and an opposite lug opening end 112, with the passage 108 and its two ends 110, 112 shown best in FIGS. 8 through 10 of the drawings. A slat locking pin, or more preferably a two piece pin assembly comprising a slat engagement component 114 and an opposite tab engagement component 116 which telescopes over the mating end of the slat engagement component, is installed within the slat locking pin passage 108. A biasing spring, or more preferably a first spring 118 and a second spring 120, is installed with the pin or pin components 114 and 116 within the pin passage 108. The two pin components 114, 116 and their two springs 118, 120 and their function are discussed in detail further below.

The mattress platform attachment lug 106 further includes a mattress platform attachment plate 122 pivotally extending therefrom, with the mattress platform 24 being attached to the plate 122 by suitable means (screws, rivets, etc.). The mattress platform 24 includes a cutout or relief 124 therein to provide clearance for the attachment plate 122 and its pivotal attachment to the lug 106, as shown in broken lines in FIG. 7. The mattress platform attachment plate 122 is secured to a pivot pin 126, which passes through a lateral passage 128 formed through the upper portion of the lug 106 above the pin passage 108. A pin actuating tab 130 extends from the mattress platform attachment plate 122, normal to the plate 122. When the plate 122 (and its attached mattress platform 24) are oriented horizontally, the tab 130 depends vertically from the plate 122 to lie adjacent to the end or edge of the lug 106, immediately over the lug opening end 112 of the locking pin passage 110, as shown in FIGS. 7 and 8.

Figure 8:
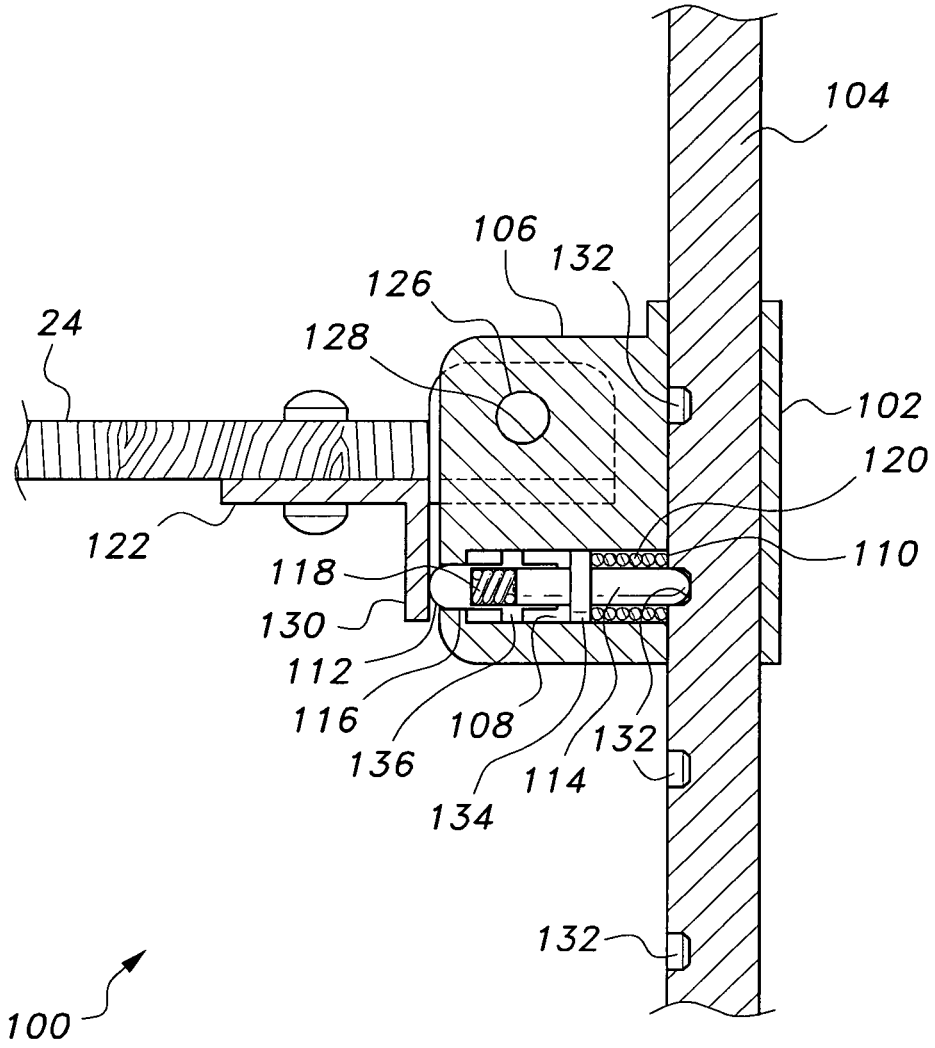
FIG. 8 is a detailed side elevation view in section of a crib slat having the second embodiment of the adjustable bracket installed thereon, showing the positive engagement of the latch pin when the mattress platform is lowered.
Figure 9:
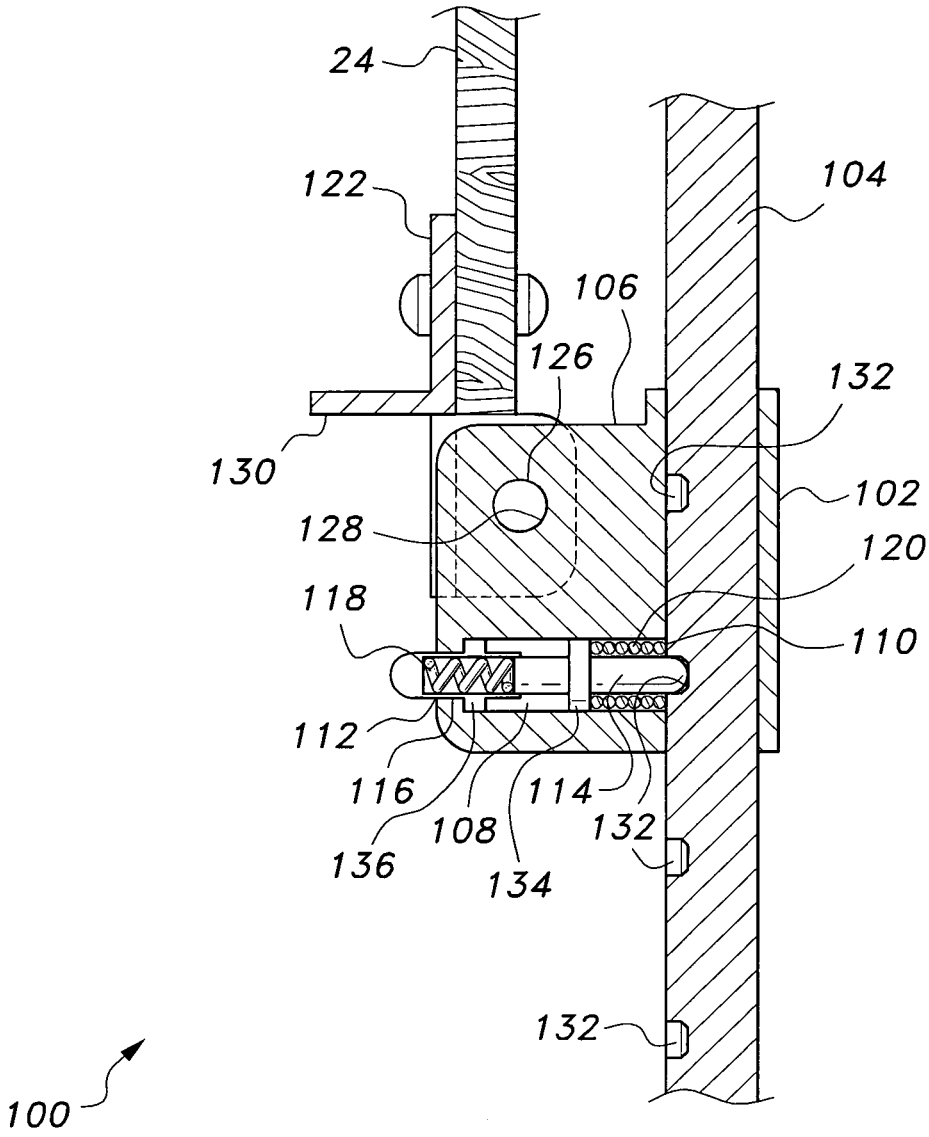
FIG. 9 is a detailed side elevation view in section of a crib slat having the second embodiment of the adjustable bracket installed thereon, with the mattress platform raised.
Figure 10:
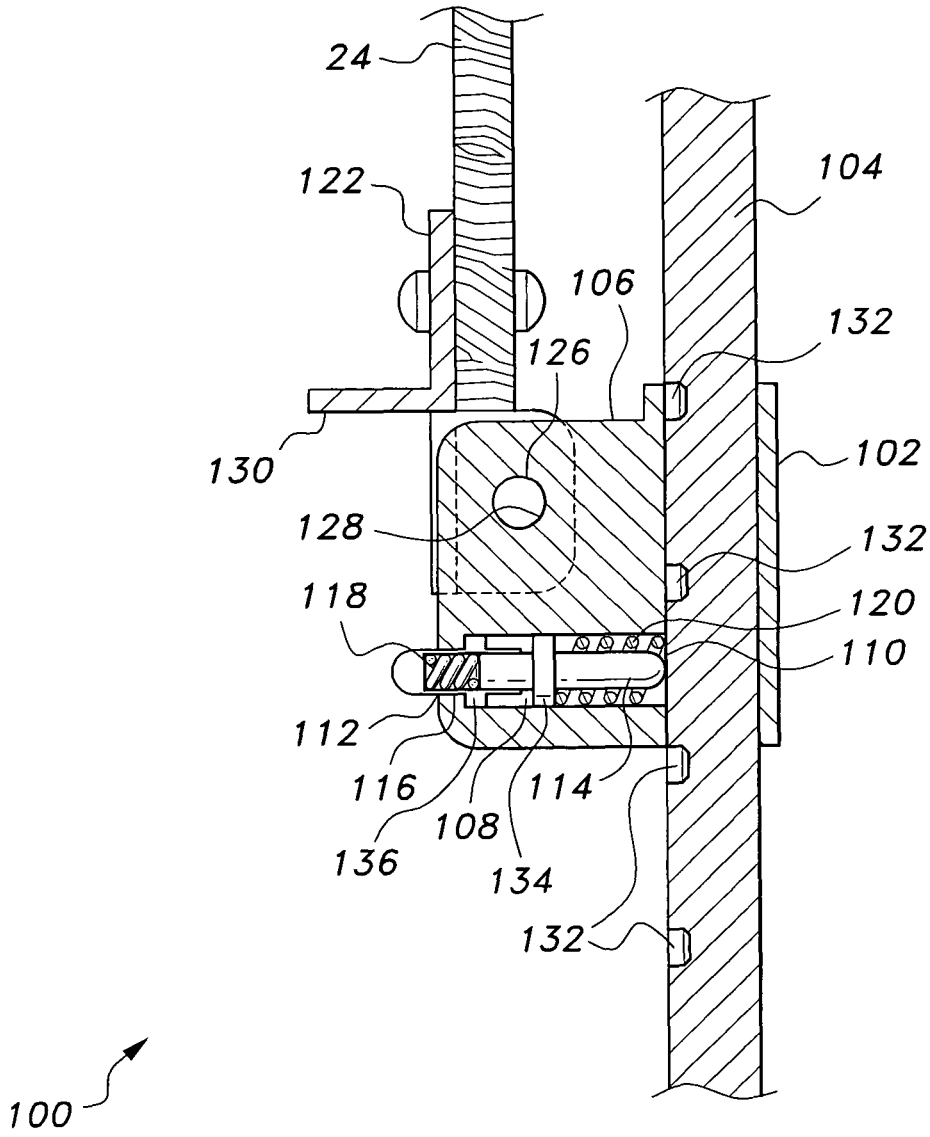
FIG. 10 is a detailed side elevation view in section of a crib slat having the second embodiment of the adjustable bracket installed thereon, with the mattress platform raised and the latch pin disengaged from any of the crib slat receptacles.

When the mattress platform 24 is lowered to an essentially horizontal position, as shown in FIGS. 7 and 8, the pin actuating tab 130 contacts the otherwise protruding end of the tab engagement pin component 116, and pushes it back into the pin passage 108. This collapses the concentric first or tab pin spring 118 installed inside the tab engagement pin component 116, between the distal end of the pin component 116 and the end of the slat engagement pin component 114, which telescopes within the pin component 116. The dimensions are such that the first or tab pin spring 118 is completely compressed when this occurs, so that the tab engagement pin component 116 (by means of the completely collapsed tab pin spring 118) forces the opposite end of the slat engagement pin component 118 to protrude from the sleeve end 110 of the pin passage 108, thus engaging a selected one of the locking pin receptacles 132 formed in the slat 104. (Normally, a series of three such receptacles 132 will be provided along each of the corresponding slats 104, but a greater number may be provided for additional adjustments if so desired, as indicated in FIGS. 8 through 10.) As the second spring 120 is captured concentrically about the slat engagement pin component 114 between a medial flange 134 thereon and the surface of the slat 104, it is also compressed as the slat engagement pin component 114 is pushed outwardly from the sleeve end 110 of the pin passage 108 to engage one of the slat receptacles 132.

When adjustment of the level of the mattress platform 24 is desired, the forward edge of the platform is raised to pivot the mattress platform 24 upwardly, generally as shown in FIGS. 9 and 10. This also pivots the pin actuating tab 130 away from the end of the of the tab engagement pin component 116, allowing that pin component 116 to protrude from the lug opening end 112 of the pin passage 108.

Extension of the pin component 116 is limited by a stop flange 136 which abuts the inside of the neck of the lug opening end 112 of the passage 108 when the pin component 116 is fully extended. However, as the first or tab pin spring 118 is stronger, i.e., has a higher spring rate, than the second or slat pin spring 120, the result is that the first spring 118 applies sufficient pressure on the end of the slat engagement pin component 114 to keep the second or slat pin component spring 120 compressed with the protruding end of the slat engagement pin component 114 remaining engaged with the previously selected one of the slat receptacles 132. Thus, the height of the mattress platform 24 and its adjuster brackets 100 cannot be inadvertently released from their engagement with the selected one of the slat receptacles 132, solely due to raising the mattress platform. This configuration is shown in FIG. 9 of the drawings.

When it is desired to adjust the height of the mattress platform 24, some additional slight upward or downward force upon the mattress platform is sufficient to overcome the bias of the slightly stronger first spring 118, allowing the protruding end of the slat engagement pin component 114 to retract with the aid of the second spring 120 and withdraw from the slat receptacle 132, as shown in FIG. 10. The height of the mattress platform 24 may then be adjusted as desired, with the engaging end of the pin component 114 slipping into the next slat receptacle 132 to hold the adjustment loosely in position at that point until the mattress platform 24 is lowered. Once the mattress platform is lowered, the tab 130 forces the pin components 114 and 116 into positive engagement with the selected slat receptacle 132 to prevent slippage therefrom, as shown in FIG. 8.

It is to be understood that the present invention is not limited to the embodiments described above, but encompasses any and all embodiments within the scope of the following claims.

The invention claimed is:

1. A crib having a mattress platform and an adjustable bracket assembly therefor, comprising in combination:

a crib having a front wall, a rear wall opposite the front wall, a first end panel, a second end panel opposite the first end panel, a first corner post joining the rear wall to the first end panel, and a second corner post joining the rear wall to the second end panel;

a flat, substantially rigid mattress platform spanning the area between the front wall, the rear wall, the first end panel, and the second end panel, the platform being adjustably disposed therein;

a flat, elongate corner post plate secured to each corner post, the plate having a height adjustment slot extending therethrough and a plurality of lands extending from the slot, wherein the height adjustment slot has a lower portion and an upper portion, the lower portion being axially offset from the upper portion and defining a straight leg portion;

a pair of mattress platform corner brackets attached to the mattress platform;

a plate engagement pin extending from each of the corner brackets and passing through the slot of a corresponding corner post plate, the pin having a distal end; and a head disposed upon the distal end of the pin, the head having a larger diameter than the pin, the head being captured behind the corner post plate when the pin is installed in the slot of the corner post plate, wherein the height adjustment slot has a passage formed therethrough for the head of the corner bracket pin, wherein the passage is located on the straight leg portion of the slot.

2. The crib, mattress platform, and adjustable bracket assembly combination according to claim 1, wherein each of the corner posts has a facing surface and each of the corner post plates has an exposed surface, the facing surface of each of the corner posts being coplanar with the exposed surface of the corresponding corner post plate.

3. The crib, mattress platform, and adjustable bracket assembly combination according to claim 1, wherein each of the corner posts has a corner bracket pin head clearance recess formed therein behind the corner post plate and opposite the corner bracket.

4. The crib, mattress platform, and adjustable bracket assembly combination according to claim 1, wherein:

each of the end panels has a first portion and a second portion, the first portion being pivotally attached to the respective second portion; and at least one end panel latch assembly is installed upon the first portion and the second portion of each of the end panels, the latch assemblies selectively locking the first portion and the second portion of each of the end panels in a coplanar configuration when the crib is deployed.

5. The crib, mattress platform, and adjustable bracket assembly combination according to claim 1, wherein at least one of the lands extending from the height adjustment slot has an arcuate upper portion and a straight lower portion extending from the arcuate upper portion.

6. The crib, mattress platform, and adjustable bracket assembly combination according to claim 1, wherein at least one of the lands extending from the height adjustment slot comprises a straight, substantially horizontal segment.

7. The crib, mattress platform, and adjustable bracket assembly combination according to claim 1, wherein the mattress platform corner bracket further comprises an upper plate, a lower plate parallel to the upper plate, and a medial plate extending normal to and connecting the upper plate and the lower plate, the plate engagement pin extending from the medial plate.

8. An adjustable bracket assembly for a crib mattress platform, comprising:

a slat attachment sleeve;

a mattress platform attachment lug extending from the sleeve, the lug having a slat locking pin passage formed therethrough substantially normal to the sleeve, the passage having a sleeve end communicating with the slat attachment sleeve and a lug opening end opposite the sleeve end;

a slat locking pin slidably installed within the slat locking pin passage, the pin having a slat engagement end and a tab engagement end opposite the slat engagement end, the slat locking pin further comprises a slat engagement component and a tab engagement component, the tab engagement component being telescopically disposed over the slat engagement component;

a mattress platform attachment plate pivotally secured to the mattress platform attachment lug; and a pin actuating tab extending from the mattress platform attachment plate, the pin actuating tab selectively contacting the tab engagement end of the pin and moving the slat locking pin within the slat locking pin passage.

9. The adjustable bracket assembly for a crib mattress platform according to claim 8, further including at least one bias spring concentrically disposed about the slat locking pin within the slat locking pin passage.

10. The adjustable bracket assembly for a crib mattress platform according to claim 8, further including:

a first spring disposed within the tab engagement component, the first spring bearing against the slat engagement component and urging the slat engagement component outwardly from the sleeve end of the slat locking pin passage; and a second spring disposed concentrically about the slat engagement component, the second spring urging the slat engagement component inwardly into the sleeve end of the slat locking pin passage, the first spring having a greater strength than the second spring, the first spring and the second spring both being completely compressed and forcing the slat engagement component to extend partially from the sleeve end of the passage when the tab bears against the lug to push the tab engagement component completely into the lug opening end of the passage.

* * * * *